United States Patent [19]

Schulze et al.

[11] 4,196,858

[45] Apr. 8, 1980

[54] NOZZLE FOR SPRAYING A MEDIUM UNDER PRESSURE

[75] Inventors: Werner Schulze, Winnenden; Wilfried Grasmann, Leutenbach; Helmut Gassert, Allmersbach I.T., all of Fed. Rep. of Germany

[73] Assignee: Alfred Karcher GmbH & Co., Winnenden, Fed. Rep. of Germany

[21] Appl. No.: 930,670

[22] Filed: Aug. 3, 1978

[30] Foreign Application Priority Data

Aug. 12, 1977 [DE] Fed. Rep. of Germany ..... 2736314

[51] Int. Cl.[2] ..... B05B 1/26

[52] U.S. Cl. ..... 239/522

[58] Field of Search ..... 239/276, 521, 547, 581, 239/600, 522, 523, 511

[56] References Cited

U.S. PATENT DOCUMENTS

| | | | |
|---|---|---|---|
| 351,087 | 10/1886 | Bean | 239/523 |
| 385,653 | 7/1888 | Wright | 239/523 |
| 442,762 | 12/1890 | Wainwright | 239/523 |

*Primary Examiner*—James B. Marbert

*Attorney, Agent, or Firm*—Lawrence E. Laubscher

[57] ABSTRACT

A nozzle for spraying a medium under pressure has a selectable form of jet. A knife edge body is rotatably mounted in front of the outlet from the nozzle bore, and has a front knife edge which breaks the jet from the bore into a spray mist when that knife edge is rotated into the jet and a rear knife edge which spreads the jet to a fan-shape when it is rotated into the jet.

26 Claims, 8 Drawing Figures

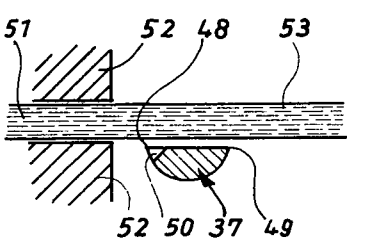
Fig. 3
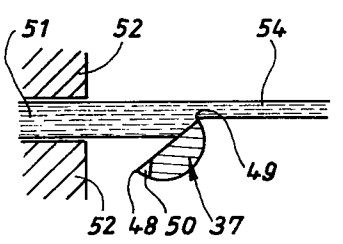
Fig. 5
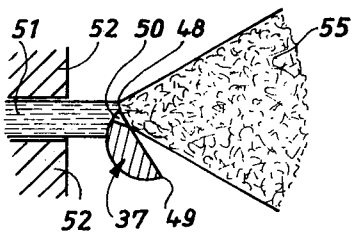
Fig. 7
Fig. 4
Fig. 6
Fig. 8

NOZZLE FOR SPRAYING A MEDIUM UNDER PRESSURE

BACKGROUND OF THE INVENTION

1. Field of the Invention

This invention relates to a nozzle for spraying a medium under pressure with a selectable form of jet, comprising a casing having a bore for passage of the medium, an outlet aperture at the end of this bore, and a knife-edge body which is mounted for rotation transversely to the direction of the jet and whose rear knife edge is adapted to penetrate to a greater or lesser depth into the jet passing out of the bore in order to fan the jet outwardly.

In many applications, for example in high-pressure cleaning machines the need arises for a medium which is under pressure and which is supplied through a pipe, for example a cleaning liquid mixed with chemicals, to be discharged in varying amounts, with variable pressure, and with a selectable form of jet. For example, when removing obstinate dirt, such as in the cleaning of stables or heavily soiled building machines, a high impact pressure is necessary in order to effect thorough cleaning. This high impact pressure is achieved by directing the cleaning liquid with a high rate of flow, a high spray pressure, and in the form of a compact circular jet, onto the surface which is to be cleaned. For cleaning large surfaces, for example building faces, swimming baths, or floors, a flat jet and a large amount of water are required. This flat jet achieves a high surface cleaning power, and the detached dirt is thoroughly flushed away by the large amount of liquid. When cleaning sensitive surfaces, for example tiled walls, the pressure of the flat jet must be reduced in order to avoid damage.

For the disinfection of the cleaned surfaces a jet in the form of a spray mist is required. With a spray mist of this kind, there is fine uniform distribution of disinfectant liquid over the surfaces to be disinfected.

2. Description of the Prior Art

In order to provide these numerous variations, nozzle systems are known in which it is possible to change over from one nozzle to another by operating a slide. The various supply passages to the nozzles are sealed relative to one another by means of O-ring seals. The disadvantage of this arrangement is that it is possible to change over only to one, two, or three predetermined jet forms and corresponding spray nozzles. Continuously variable regulation of the three components: spray pressure, spray flow and jet shape is not possible in these arrangements.

Rotary change-over nozzles are also known in which four different nozzle openings giving different jet angles are provided in a nozzle disc, which is turned by means of a seal which pressed resiliently into contact, until the desired nozzle opening lies above the liquid supply hole. Continuously variable adaptation to the cleaning task is not possible with this arrangement.

The problem underlying the invention is that of so improving a nozzle of the kind defined that the amount and the pressure of the medium delivered, and also the shape of the jet, can be continuously varied.

SUMMARY

The invention provides a nozzle comprising a casing with a bore for passage of the medium to be sprayed and a double knife edge body rotatably mounted in front of an outlet aperture of the bore, which body has a front knife edge which faces the outlet aperture and which breaks up the jet into a spray mist when it is turned into the jet, and a rear knife edge which when turned into the jet fans the jet outwardly.

Preferably the cross-section of the knife edge body is in the form of a segment of a circle, and the knife edges are the edges where the peripheral curved surface of the body intersects the chord at surface of the body.

Because of the penetration of the front or rear knife edge to a greater or lesser depth into the jet passing out of the outlet aperture of the bore, continuously variable forms of jet can be produced. If the rear knife edge which is remote from the outlet aperture, is turned inwardly, this leads to a reduction of the height of the jet and to the fanning out of the jet in a plane extending parallel to the knife edge. Penetration of the front knife edge into the jet breaks up the jet completely and produces a spray mist. When neither the front nor the rear knife edge penetrates into the jet, the medium passes out in the form of a compact jet.

Therefore the variable shaping of the jet is effected not by selecting different nozzles, but by introducing differently shaped knife edges into the compact jet. Consequently, all shapes of jet between a compact circular jet and a thin widely fanned out jet, or between a compact circular jet and a spray mist, can be produced in a continuously variable manner.

Provision may be made for adjusting the rate of flow and spray pressure by providing at least one slide which is adapted to be inserted into the bore and is slidably mounted and sealed in the casing, and which, depending on its depth of insertion, reduces to a greater or lesser extent the cross-section of the bore. For positioning the slide an eccentric disc may be rotatably mounted on the casing, the slide bearing firmly against an eccentric surface of the disc by the action of the pressure of the medium flowing in the bore, so that the depth of insertion of the slide is adjusted by turning the disc.

Two slides may be inserted into the bore each having an associated eccentric surface on a disc, which discs are disposed one behind the other on the casing upstream of the outlet opening. The amount of liquid allowed through the bore is regulated by the first slide, while, for a predetermined flow of liquid, the second slide regulates the outlet cross-section of the bore and consequently the spray pressure. The shape of the jet is determined by means of the knife edge body mounted beyond the outlet aperture.

BRIEF DESCRIPTION OF THE DRAWINGS

Some embodiments of the invention will now be described, by way of example, with reference to the accompanying drawings, in which:

FIG. 4 is a diagrammatic plan view of the jet with the knife edge body in the position corresponding to FIG. 3, FIG. 5 is a view similar to FIG. 3 with a knife edge body whose rear knife edge penetrates into the jet, FIG. 6 is a view similar to FIG. 4 with the knife edge body in the position shown in FIG. 5, FIG. 7 is a view similar to FIG. 3 with a knife edge body whose front edge penetrates into the jet, and FIG. 8 is a view similar to FIG. 4 with the knife edge body in the position shown in FIG. 7.

DESCRIPTION OF THE PREFERRED EMBODIMENTS

Figure 2:
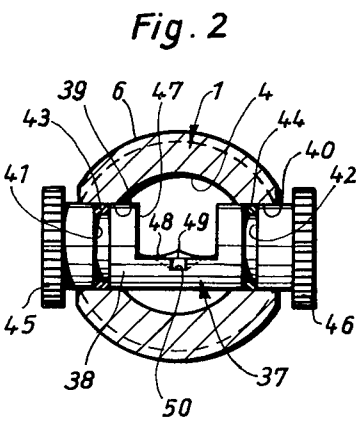
FIG. 2 is a side view on the line 2—2 of FIG. 1, FIG. 3 a diagrammatic side view of the jet from the nozzle with the knife edge body not turned into the jet.

The nozzle according to the invention comprises a nozzle body or casing 1 having a bore 2 which has an outlet aperture 3 at one end of the casing adjoining which aperture 3 there is a funnel-shaped or conical portion 4 of the casing. At the opposite end to the outlet aperture 3 an extension tube 5 is joined to the casing 1 which tube is either formed directly by a pipe which supplies to the nozzle the medium which is to be sprayed, or is adapted to be connected by connection means (not shown) to such a pipe.

The casing 1 surrounds the bore 2 concentrically and has a circular cylindrical outer surface 6. On this outer surface 6 two adjusting discs 7, 8 are mounted for rotation about the longitudinal axis of the bore, each disc having an inner annular recess, 9 and 10 respectively, which is eccentric in the radial direction. Axial displacement of the disc 7 is prevented by an annular shoulder 11 on the casing 1, and axial displacement of the disc 8 is prevented by a stop disc 12 and an associated spring ring 13. Annular grooves 16 and 17 respectively are cut in the inner surfaces 14 and 15 of the discs 7 and 8, and an O-ring 18, 19 of elastic material is inserted into each groove. The O-rings are maintained by the discs under pressure against the outer surface 6 of the casing 1, and therefore offer resistance to the turning of the discs 7 and 8. The discs are thus secured in an angular position after adjustment.

The discs 7 and 8 are preferably made of plastics material and are each in the form of a scale or carry a scale which cooperates with a corresponding marker 20 fixed to the casing 1, so that the angular positions of the discs can be read.

Slides 23 and 24 are respectively inserted into radial openings 21 and 22 in the casing 1, the respective free ends 25 and 26 of which slides penetrate to a greater or lesser depth into the bore 2 depending on the depth of insertion. The slides are sealed by annular seals 29 and 30, which are inserted into annular grooves 27,28 in the peripheries of the slides and which are pressed against the inner surfaces of the openings 21 and 22. The annular seals 29 and 30 offer a certain additional resistance to the movement of the slides, so that the position of the slides is fixed when there is no superatmospheric pressure in the bore.

The ends 31 and 32 of the slides which project outwardly from the openings 21 and 22, bear against the eccentric surfaces 33 or 34 of the respective inner recesses 9 and 10, and are pressed firmly against them when a superatmospheric pressure is built up in the bore by the medium which is to be sprayed. Depending on the angular position of the discs 7 and 8, and consequently the position of the eccentric surfaces 33 or 34, the slides 23 and 24 penetrate to different depths into the bore 2 and thus correspondingly reduce the cross-sectional area of the said bore.

A shoulder 35 is formed in the bore 2 in a position opposite the slide 24 and directly adjoining the outlet aperture 3, and in conjunction with the slide 24 the said shoulder determines the effective outlet cross-section of the bore 2 in the region of the outlet aperture 3.

A flow regulator 36 is inserted in the bore between the two slides 23 and 24 and rectifies any turbulence of the medium flowing through the bore, which may be caused by the projection of the slide 23 into the bore, so that there is substantially laminar flow in the remainder of the bore 2. As shown in the embodiment illustrated, the regulator 36 may consist of a multiplicity of parallel guide walls, as is known per se. Other known constructions may be used.

Downstream of the outlet aperture 3 a knife edge 37 is mounted in the funnel-shaped portion 4 of the casing, for rotation in the portion 4 about an axis extending transversely to the longitudinal direction of the bore. As can be seen in FIG. 2, the knife edge body consists of a cylindrical shaft 38, which is mounted for rotation in bearing bores 39 and 40 at opposite sides of the casing 1. In the region of the bearing bores O-rings 43 and 44 respectively are inserted in peripheral grooves 41 and 42 in the shaft 38 and are pressed by the shaft against the inner surfaces of the bearing bores 39 and 40. Consequently a certain resistance is offered to the turning of the shaft 38, which is turned by means of handwheels 45 and 46 connected to the shaft, so that the angular position of the shaft is secured against unintentional rotation.

Each of the handwheels 45 and 46 may be in the form of a scale or may carry a scale, so that in conjunction with a fixed marking on the casing, not shown in the drawing, the various angular positions of the shaft can be determined.

Figure 1:
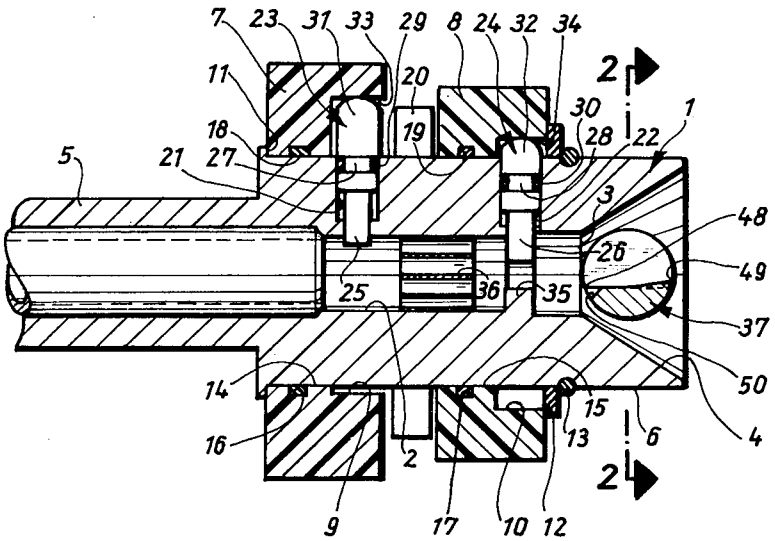
FIG. 1 is a sectional side view of a nozzle according to the invention, having a knife edge body in its outlet.

In its middle portion the shaft 38 has a cutout 47, so that in this region the shaft consists only of a portion whose cross-section is substantially in the form of a segment of a circle, as is shown in FIG. 1. The cutout can for example be produced by cutting into the shaft a groove extending transversely to its longitudinal direction. The bottom of the cutout, which is referred to below as the operative surface of the knife edge body, is in this case completely flat.

This surface and the periphery of the knife edge body together form a front knife edge 48 and a rear knife edge 49, FIG. 1. If the surface of the knife edge body is flat, rectilinear knife edges are formed.

In a preferred example of embodiment of the invention however the surface is so shaped that it rises in the centre in the direction of the rear knife edge. This rise may be rectilinear, but the cross-sectional line of the rise may also be characterised by different shapes; for example it may extend in the form of a parabola or hyperbola. In accordance with the cross-sectional line selected the shape of the rear knife edge 49 also changes, this shape then likewise rising towards the centre, as shown in the example of embodiment illustrated in FIG. 1 and FIG. 2.

The knife edge body preferably has a highly resistant coating in the region of the knife edges, for example a coating of ceramic material. In addition, it is advantageous for the knife edge body to be polished, at least in this region.

Provision may be made for grooves 50, which diverge from the centre of the front knife edge 48, to be formed in the surface, these grooves assisting the formation of a spray mist jet, as is explained later.

The axis of rotation of the knife edge body 37 is so positioned in the casing 1 that the jet which passes out of the outlet aperture 3, and the cross-section of which is substantially determined by the shoulder 35 and the slide 27, can flow past the knife edge body 37 substantially unaffected when the body 37 is in the position shown in FIG. 1, in which the surface is parallel to the flow.

The function of the nozzle will now be explained with reference to FIGS. 3 to 8.

Before the medium under pressure is introduced, the nozzle is set for a desired flow and a desired jet pressure. This is done by turning the discs 7 and 8, to cause the slides 23 and 24 to penetrate to different depths into the bore 2. The slide 23 regulates the flow, and the slide 24 the jet pressure of the medium. The scales associated with the discs 7 and 8 are preferably calibrated appropriately. As soon as the medium under pressure enters the bore 2 it presses the slides 23 and 24 against the eccentric surfaces 33 and 34 to the penetration depth defined by the angular position of the disc as set by the scale. The slides then remain unchanged in this position, and at the same time bear firmly against the eccentric surfaces 33 or 34 they prevent turning of the discs 7 and 8.

As the result of the adjustment of the slides 23 and 24, a compact, parallel jet with a preselectable flow and also with a preselectable cross-section and consequently a preselectable pressure is achieved at the outlet opening 3. This jet has the reference numeral 51 in FIGS. 3 to 8. In these Figures the walls 52 which determine the cross-section of the jet, and which are formed by the shoulder 35, the slide 24, and the side walls of the bores 2, as shown diagrammatically. The operative part of the knife edge body 37 is also shown diagrammatically.

In a first position, illustrated in FIGS. 3 and 4, the knife edge body 37 is turned in such a manner that it does not come into contact with the jet 51, so that the jet passes out of the nozzle with an unchanged cross-sectional shape. A parallel-sided compact jet 53 is thus obtained.

In the position of the knife edge body 37 shown in FIGS. 5 and 6 the body 37 is turned in such a way that its rear knife edge 49 penetrates into the jet 51. The operative cross-section of the jet is thus reduced, that is to say the outgoing jet 54 has a reduced height, as can be seen in FIG. 5. At the same time, however, the jet is fanned out in a plane extending parallel to the axis of the knife edge body, as is shown in FIG. 6. A flat, fan-shaped jet is thus obtained. The height of this jet and the angle at which it fans out can be continuously varied by turning the shaft 37 so that the rear knife edge 49 of the knife edge body penetrates to a greater or lesser depth into the jet 51.

The shaped rear knife edge 49 as shown in FIG. 2, in which the edge 49 rises towards the centre is particularly advantageous if the jet 51 has an approximately circular cross-section. The knife edge 48 then penetrates more deeply into the jet 51 at the core of the jet than at the edge regions. Because of the unequal depth of penetration the resulting fan-shaped jet is particularly uniform. In addition, the central rise of the surface of the knife edge body assists the fanning-out of the jet.

If the knife edge body 37 is turned in the other direction, the front knife edge 48 penetrates into the jet 51, as shown in FIGS. 7 and 8. The knife edge 48 and the divergent grooves 50 in the surface then break up the jet to such an extent that a conically widening jet 55 of fine and very fine droplets is formed beyond the knife edge body. The angle of the conical jet and size of the droplets depends on the depth of penetration of the knife edge 48.

With the nozzle according to the invention it is thus possible for the flow, delivery pressure, and shape of the jet to be continuously varied, the individual parameters being adjustable substantially independently of one another, although for example the shape of the jet depends to a certain extent on the delivery pressure. The shape of the jet can be varied during delivery of the medium, so that a required shape of jet can be produced at any time during use of the nozzle.

We claim:

1. A nozzle for spraying a medium under pressure with a selectable form of jet, comprising a casing formed with a bore for passage of the medium, which bore defines an outlet aperture at one end of the bore, and a knife edge body rotatably mounted in front of the outlet aperture about an axis transverse to the direction of the jet, which body has a front knife edge which faces the outlet aperture and is so shaped that, when it is turned into the jet it breaks the jet into a spray mist, and a rear knife edge which is shaped to fan the jet outwardly when it is turned into the jet.

2. A nozzle according to claim 1, wherein the rear knife edge rises towards the centre of the knife edge body so that the central portion of the rear knife edge penetrates more deeply into the jet than the side portions.

3. A nozzle according to claim 1, wherein the cross-section of the knife edge body is in the form of a segment of a circle, and the knife edges are the edges where the peripheral curved surface of the body intersects the chordal surface of the body.

4. A nozzle according to claim 3, wherein the rear knife edge rises towards the centre of the knife edge body so that the central portion of the rear knife edge penetrates more deeply into the jet than the side portions.

5. A nozzle according to claim 4, wherein the chordal surface of the knife edge body which adjoins the rear knife edge rises towards the centre from the region adjoining the front knife edge where that surface is flat.

6. A nozzle according to claim 3 or claim 4, wherein the chordal surface of the knife edge body is formed with grooves which begin at the front knife edge.

7. A nozzle according to claim 3 or claim 4, wherein the chordal surface of the knife edge body is formed with grooves which diverge from the centre of the front knife edge towards the rear knife edge.

8. A nozzle according to claim 3, wherein the knife edge body has a wear-resistant coating at least in the region of the knife edges.

9. A nozzle according to claim 8, wherein the wear-resistant coating is a ceramic coating.

10. A nozzle according to claim 8 or claim 9, wherein the wear-resistant coating is polished.

11. A nozzle according to claim 3, wherein the knife edge body is a cylindrical shaft of circular cross-section which in the middle region is cut away to form said chordal surface and the knife edges.

12. A nozzle according to claim 11, wherein the knife edge body is mounted for rotation in the casing and brake rings are interposed between the knife edge body and the casing to hold an angular position of the body once it has been selected.

13. A nozzle according to claim 12, wherein the brake rings are O-rings inserted into annular grooves in the knife edge body and pressed against the inner wall of a bearing bore in the casing.

14. A nozzle according to claim 11, wherein at least one handwheel in the form of a disc carrying a scale is secured to the knife edge body, and a marking associated with the scale is provided on the casing.

15. A nozzle according to claim 14, wherein said at least one handwheel is made of plastics material.

16. A nozzle according to claim 1, including, in the casing, a device for adjusting the spray flow and spray pressure, which device comprises at least one slide which is slidably mounted and sealed in the casing and is adapted to be inserted into the bore.

17. A nozzle according to claim 16, including a seal inserted in a peripheral groove in the slide, which seal is pressed against the inner wall of an opening in the casing in which the slide is mounted, and seals the slide relative to the casing and fixes the depth of penetration of the slide.

18. A nozzle according to claim 16, including a disc rotatably mounted on the casing and having an eccentric surface against which the slide bears through the action of the pressure of the medium flowing in the bore, so that the depth of penetration of the slide into the bore can be adjusted by turning the disc.

19. A nozzle according to claim 18, wherein the disc is mounted on the casing concentrically to the bore, and a brake ring is pressed between the inner surface of the disc and the outer surface of the casing to fix the angular position of the disc on the casing.

20. A nozzle according to claim 19, wherein the brake ring is an O-ring inserted into an annular groove in the inner surface of the disc.

21. A nozzle according to claim 18 or 19, characterised in that the discs (7, 8) are made of plastics material.

22. A nozzle according to claim 18 or claim 19, wherein the disc has a scale, and a co-operating fixed marker for the scale is provided on the casing.

23. A nozzle according to claim 18, including, upstream of the outlet opening, two slides adapted to be inserted into the bore with associated discs with eccentric surfaces, which discs are spaced apart on the casing.

24. A nozzle according to claim 23, including a flow regulating element inserted in the bore between the two slides to remove turbulence from the flow through the bore.

25. A nozzle according to claim 23 or claim 24, including a shoulder which projects into the bore opposite the slide adjoining the outlet opening.

26. A nozzle according to any one of claims 1 to 5, wherein the casing is formed with a funnel-shaped extension opening from the outlet aperture, and the knife edge body is rotatably mounted in that extension.

* * * * *